US007360959B2

(12) United States Patent
Sawada et al.

(10) Patent No.: US 7,360,959 B2
(45) Date of Patent: Apr. 22, 2008

(54) PRINTER APPARATUS

(75) Inventors: Kouichi Sawada, Daito (JP); Masaaki Takagi, Daito (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 323 days.

(21) Appl. No.: 11/314,885

(22) Filed: Dec. 21, 2005

(65) Prior Publication Data

US 2006/0147244 A1 Jul. 6, 2006

(30) Foreign Application Priority Data

Jan. 4, 2005 (JP) ..... 2005-000103

(51) Int. Cl.
*B41J 29/13* (2006.01)

(52) U.S. Cl. ..... 400/642; 400/647; 400/693; 271/145; 271/162; 347/108

(58) Field of Classification Search ..... 400/642, 400/645.3, 645.4, 647, 647.1, 691, 693; 271/145, 271/162; 347/101, 104, 108
See application file for complete search history.

(56) References Cited

U.S. PATENT DOCUMENTS 6,848,685 B2 * 2/2005 Katsuyama ..... 271/162
7,147,219 B2 * 12/2006 Soo ..... 271/157
2002/0063374 A1 * 5/2002 Takahashi ..... 271/10.01
2006/0017217 A1 * 1/2006 Maeda ..... 271/162
2006/0220295 A1 * 10/2006 Bandou et al. ..... 271/3.03

FOREIGN PATENT DOCUMENTS

JP 02-043836 3/1990

OTHER PUBLICATIONS

Japan Patent Office, Application No. 02-043836, dated Mar. 27, 1990 (1 page).
Partial English translation of JP-02-043836, dated Mar. 27, 1990 (2 pages).

* cited by examiner

*Primary Examiner*—Daniel J. Colilla
*Assistant Examiner*—Kevin D. Williams
(74) *Attorney, Agent, or Firm*—Osha Liang LLP

(57) ABSTRACT

A printer body of a printer apparatus is provided with paired bearing portions such that the paired bearing portions face each other, while a paper support for supporting a paper sheet is provided with paired rotating shaft portions, which are rotatably journaled by the paired bearing portions. Each of the rotating shaft portions includes a shaft body and a shaft support portion for supporting the shaft body. The shaft support portion is provided at a flat plate portion of the paper support. A tab portion is formed at the shaft support portion. Each of the paired bearing portions includes a bearing body provided with an opening for receiving the shaft body. At the bearing body, an engaging portion is formed to receive the tab portion to restrict axial movement of the rotating shaft portions. As a result, it is possible to provide a printer apparatus having a paper support less likely to detach from the printer body.

5 Claims, 6 Drawing Sheets

PRINTER APPARATUS

BACKGROUND OF THE INVENTION

1. Field of the Invention

The present invention relates to a printer apparatus, and particularly to a printer apparatus having a paper support.

2. Description of the Background Art

One type of printer apparatuses is a printer apparatus having a paper support for supporting a paper sheet during printing operation attached thereto. A printer apparatus having such a paper support will now be described. As shown in FIG. 9, this type of printer apparatus 101 includes a printer body 102 for printing on a paper sheet, and a paper support 110 for supporting the paper sheet. For paper support 110, a resin-molded paper support is generally used.

Paired bearing portions 103 are provided at printer body 102 to face each other, while paired rotating shaft portions 111, which are rotatably journaled by paired bearing portions 103, are provided at paper support 110. As shown in FIG. 10, each of rotating shaft portions 111 of paper support 110 is provided with a shaft body 112 protruding outward from paper support 110, while printer body 102 is provided with bearing portions 103 for rotatably journaling shaft bodies 112, respectively, in such a manner that paired rotating shaft portions 111 are held thereby. Each of bearing portions 103 is provided with an opening 104 for receiving shaft body 112.

When printer apparatus 101 is used for printing operation, a paper sheet (not shown) is placed on paper support 110 by allowing paper support 110 to stand at a prescribed angle with respect to printer body 102. The paper sheet placed on paper support 110 is then fed to printer body 102 in accordance with the printing operation of printer body 102. As for the paper support, Japanese Utility Model Application Laying-Open No. 02-043836 proposes a facsimile machine having a paper support made of wire.

However, the conventional printer apparatus suffers from the following problems. In this type of printer apparatus 101, as described above, paper support 110 is opened to stand with respect to printer body 102 and used. In contrast, when printer apparatus 101 is transported, paper support 110 is tilted toward printer body 102 and closed for being packaged. Paper support 110 is made of resin and the like, and thus, when an impact is exerted on paper support 110 during transportation, paper support 110 easily deforms.

In particular, as shown in FIG. 11, when such an impact as to deform paper support 110 as shown in a dotted line 121 is exerted on paper support 110, each of rotating shaft portions 111 of paper support 110 deforms in a direction away from each of bearing portions 103 (an arrow 122). Therefore, shaft body 112 of each of rotating shaft portions 111 is detached from opening 104 of each of bearing portions 103, resulting in that paper support 110 is inevitably detached from printer body 102. To overcome such problems, an additional procedure such as fixing of paper support 110 to printer body 102 with a tape 115, as shown in FIG. 12, for example, is required.

SUMMARY OF THE INVENTION

The present invention is made to overcome the problems above. An object of the present invention is to provide a printer apparatus having a paper support less likely to detach from a printer body.

A printer apparatus according to the present invention includes a printer body for printing on a paper sheet, a paper support, paired bearing portions, and paired rotating shaft portions. The paper support is attached to the printer body, and includes a flat plate portion for supporting the paper sheet to be fed to the printer body. The paired bearing portions are provided at the printer body to face each other. The paired rotating shaft portions are provided at the paper support, and rotatably journaled by the paired bearing portions. Each of the paired rotating shaft portions includes a shaft body, a shaft support portion, a tab portion, and a protruding portion. The shaft body protrudes from a side opposite to a side where the paired rotating shaft portions face each other. The shaft support portion is provided at the flat plate portion to support the shaft body. The tab portion is provided at the shaft support portion. The protruding portion is formed at the shaft support portion on the side opposite to the side where the paired rotating shaft portions face each other. Each of the paired bearing portions includes a bearing body, an engaging portion, and a recess. The bearing body receives and journals the shaft body. The engaging portion is formed at the bearing body on a side where the paired bearing portions face each other, and receives the tab portion to restrict axial movement of the rotating shaft portions. The recess is formed at the bearing body on the side where the paired bearing portions face each other, and receives the protruding portion. When the protruding portion is received in the recess, and the paper support is opened to stand with respect to the printer body so that the paper sheet can be fed, the tab portion disengages from the engaging portion, resulting in that the paper support is made detachable from and attachable to the printer body. In contrast, when the paper support is tilted toward the printer body to be closed, the tab portion engages the engaging portion, resulting in that axial movement of the paper support is restricted.

According to this configuration, even if the paper support deflects in a direction away from or toward the printer body while the paper support is closed, the tab portion provided at each of the rotating shaft portions of the paper support engages the engaging portion provided at each of the bearing portions. Therefore, axial movement of the paper support is restricted. As a result, even if a certain impact is exerted on the paper support to deflect the same during transportation of the printer apparatus, the rotating shaft portions of the paper support can be prevented from detaching from the bearing portions.

Another printer apparatus according to the present invention has a printer body for printing on a paper sheet, a paper support, paired bearing portions, and paired rotating shaft portions. The paper support is attached to the printer body for supporting the paper sheet to be fed to the printer body. The paired bearing portions are provided at the printer body to face each other. The paired rotating shaft portions are provided at the paper support, and rotatably journaled by the paired bearing portions. Each of the paired rotating shaft portions includes a tab portion. Each of the paired bearing portions includes an engaging portion for receiving the tab portion to restrict axial movement of the rotating shaft portions. When the paper support is opened to stand with respect to the printer body so that the paper sheet can be fed, the tab portion disengages from the engaging portion, resulting in that the paper support is made detachable from and attachable to the printer body. In contrast, when the paper support is tilted toward the printer body to be closed, the tab portion engages the engaging portion, resulting in that axial movement of the paper support is restricted.

According to this configuration, even if the paper support deflects while the paper support is closed, the tab portion provided at each of the rotating shaft portions of the paper support engages the engaging portion provided at each of the bearing portions. Therefore, axial movement of the paper support is restricted. As a result, even if a certain impact is exerted on the paper support to deflect the same during transportation of the printer apparatus, the rotating shaft portions of the paper support can be prevented from detaching from the bearing portions.

As to the manner in which the rotating shaft portions are journaled by the bearing portions, the paired rotating shaft portions are preferably journaled at the paired bearing portions on either of sides where the paired bearing portions face each other, and sides opposite to the sides where the paired bearing portions face each other.

In both of the manners of journaling, it is preferable that each of the paired rotating shaft portions includes a shaft body, that each of the paired bearing portions includes a bearing body for receiving and journaling the shaft body, and that the shaft body is formed to protrude toward the bearing body.

Furthermore, each of the paired rotating shaft portions includes a protruding portion protruding toward a corresponding bearing portion of the paired bearing portions. Each of the paired bearing portions includes a recess for receiving the protruding portion. When the protruding portion is received in the recess, it is possible to clearly show when the paper support is opened to stand with respect to the printer body so that the paper sheet can be fed.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
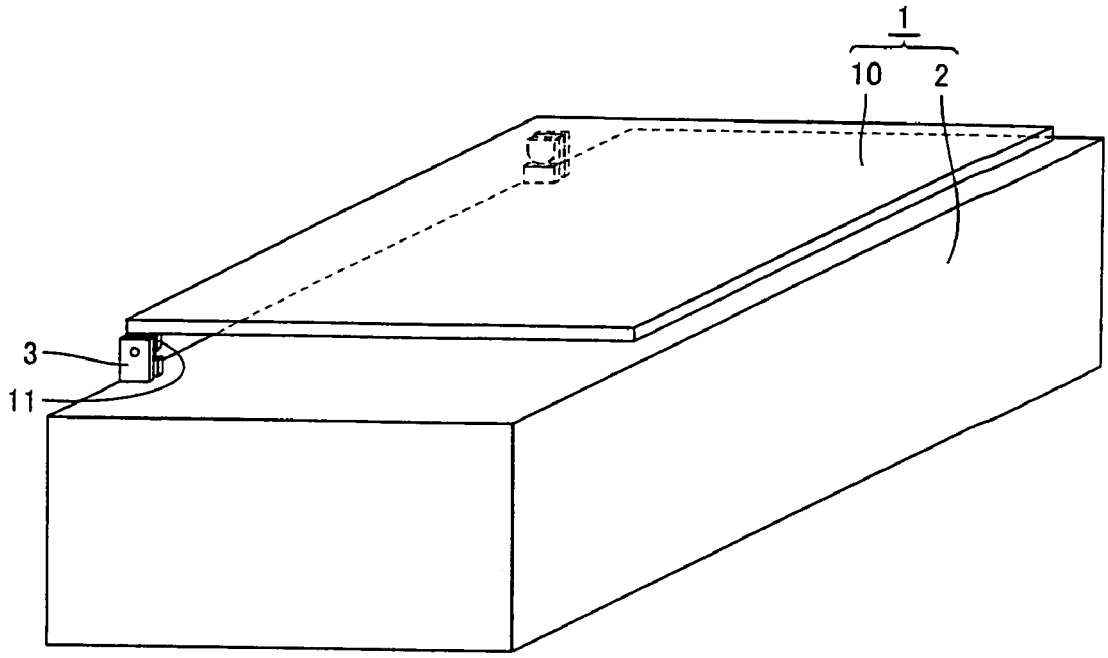
FIG. 1 is a perspective view of a printer apparatus according to an embodiment of the present invention.

A printer apparatus according to the present embodiment of the present invention will now be described. As shown in FIG. 1, a printer apparatus 1 includes a printer body 2 for printing on a paper sheet, and a paper support 10 for supporting the paper sheet. Paired bearing portions 3 are provided at printer body 2 to face each other, while paired rotating shaft portions 11, which are rotatably journaled by paired bearing portions 3, are provided at paper support 10. Bearing portions 3 and rotating shaft portions 11 will be described in more detail.

Figure 2:
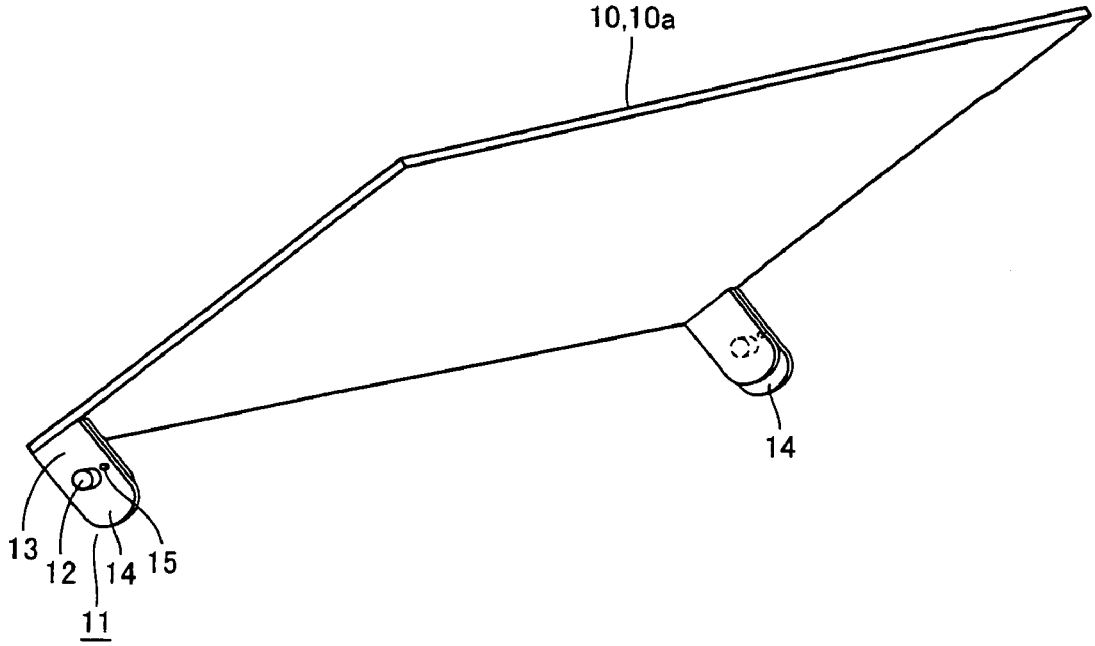
FIG. 2 is a perspective view showing a rotating shaft portion provided at a paper support of the printer apparatus shown in FIG. 1 in the present embodiment.

As shown in FIG. 2, each of paired rotating shaft portions 11 includes a shaft body 12 protruding from a side opposite to a side where paired rotating shaft portions 11 face each other, and a shaft support portion 13 for supporting shaft body 12. Shaft support portion 13 is provided to stand at a flat plate portion 10*a* of paper support 10. At shaft support portion 13, a tab portion 14 is formed to protrude in an extending direction of shaft support portion 13 (in a direction approximately orthogonal to the flat plate portion). Furthermore, at shaft support portion 13, a protruding portion 15 is provided to protrude in the same direction as shaft body 12 protrudes.

Figure 3:
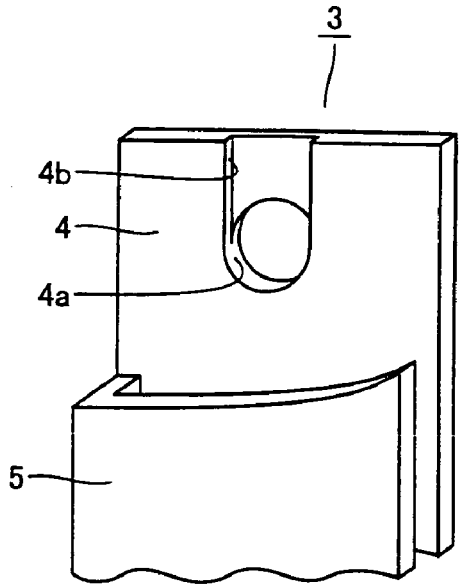
FIG. 3 is a perspective view showing a bearing portion provided at a printer body of the printer apparatus shown in FIG. 1 in the present embodiment.

As shown in FIG. 3, each of paired bearing portions 3 includes a bearing body 4 provided with an opening 4*a* for receiving shaft body 12. An engaging portion 5 for receiving tab portion 14 to restrict axial movement of rotating shaft portions 11 is formed at bearing body 4 on a side where paired bearing portions 3 face each other. Furthermore, a recess 4*b* for receiving protruding portion 15, which is formed at each of rotating shaft portions 11, at a prescribed position (within a prescribed angular range) is formed at bearing body 4.

Figure 4:
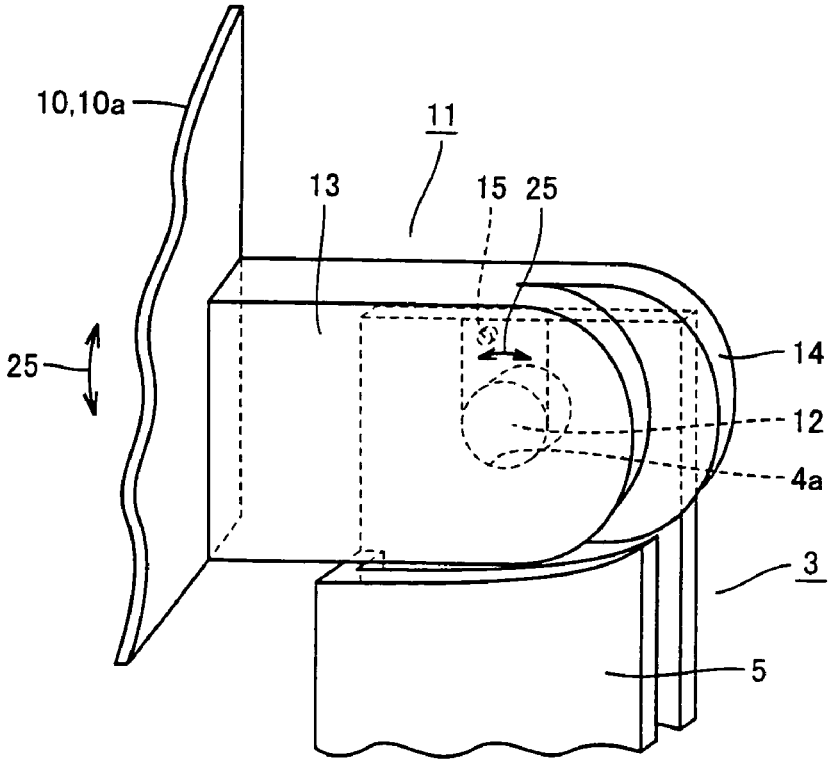
FIG. 4 is a first, partial, perspective view showing a positional relation between the rotating shaft portion of the paper support and the bearing portion of the printer body in the present embodiment.
Figure 5:
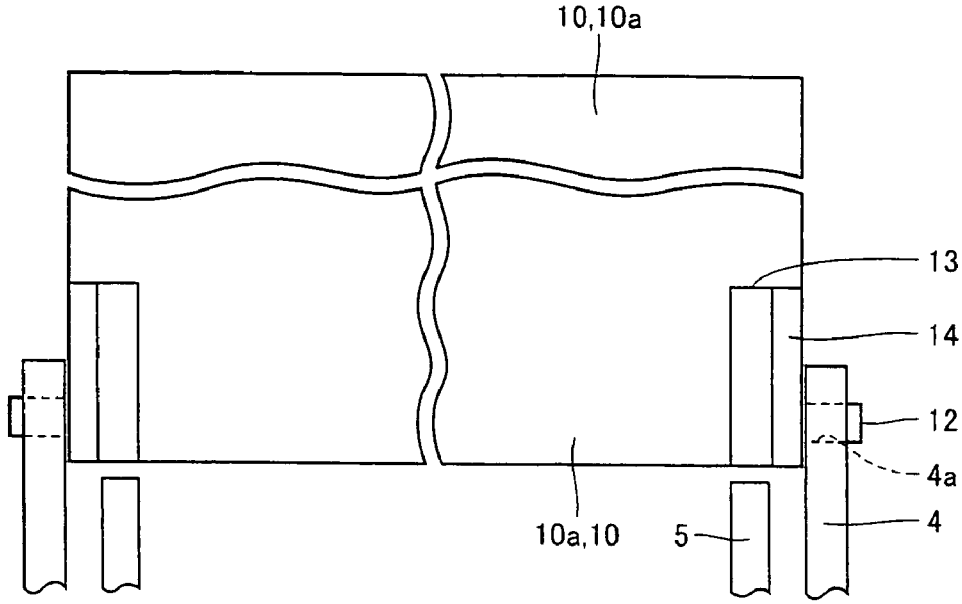
FIG. 5 is a front view showing a relation between the paper support and each of the bearing portions in the state shown in FIG. 4.

The manner in which paper support 10 in the above-described printer apparatus 1 is used will now be described. As shown in FIGS. 4 and 5, when paper support 10 is opened to stand at a prescribed angle with respect to the printer body, paper support 10 can feed a paper sheet. In this state, tab portion 14 provided at each of rotating shaft portions 11 disengages from engaging portion 5 provided at each of bearing portions 3, and thus axial movement of paired rotating shaft portions 11 is not restricted. Therefore, when paper support 10 is deformed such that rotating shaft portions 11 are allowed to approach each other in an axial direction, shaft body 12 can be detached from opening 4*a*. Consequently, paper support 10 is made detachable from and attachable to printer body 2.

Moreover, when paper support 10 is opened, protruding portion 15 provided at each of rotating shaft portions 11 is received in recess 4*b* provided at each of bearing portions 3. In accordance with a positional relation between a region of recess 4*b* and protruding portion 15, it is possible to set the degree to (the angular range at) which paper support 10 is opened with respect to the printer body. Moreover, the state where protruding portion 15 is received in recess 4*b* produces less friction between protruding portion 15 and each of bearing portions 3, and allows smoother rotational movement (an arrow 25) of paper support 10, when compared with the state where protruding portion 15 is not received in recess 4*b*. Therefore, it is also possible to determine with ease when paper support 10 can feed a paper sheet.

Figure 6:
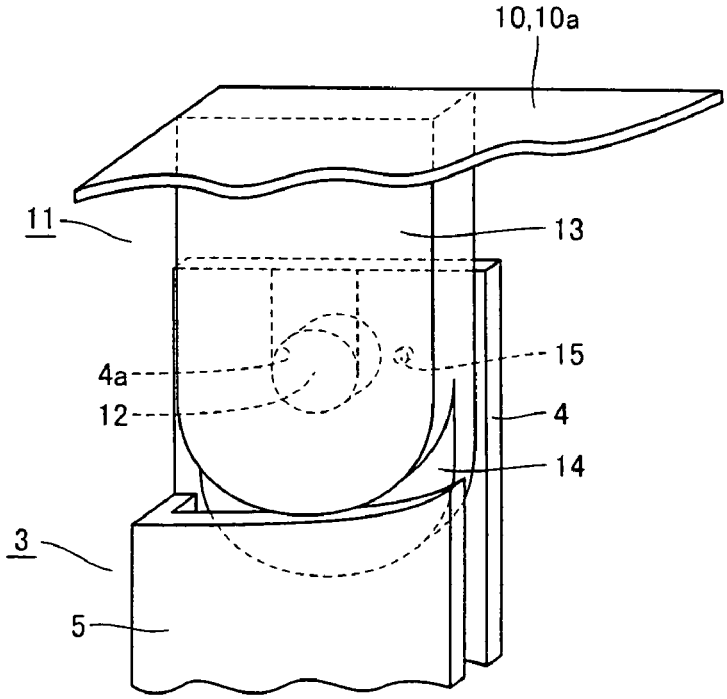
FIG. 6 is a second, partial, perspective view showing a positional relation between the rotating shaft portion of the paper support and the bearing portion of the printer body in the present embodiment.
Figure 7:
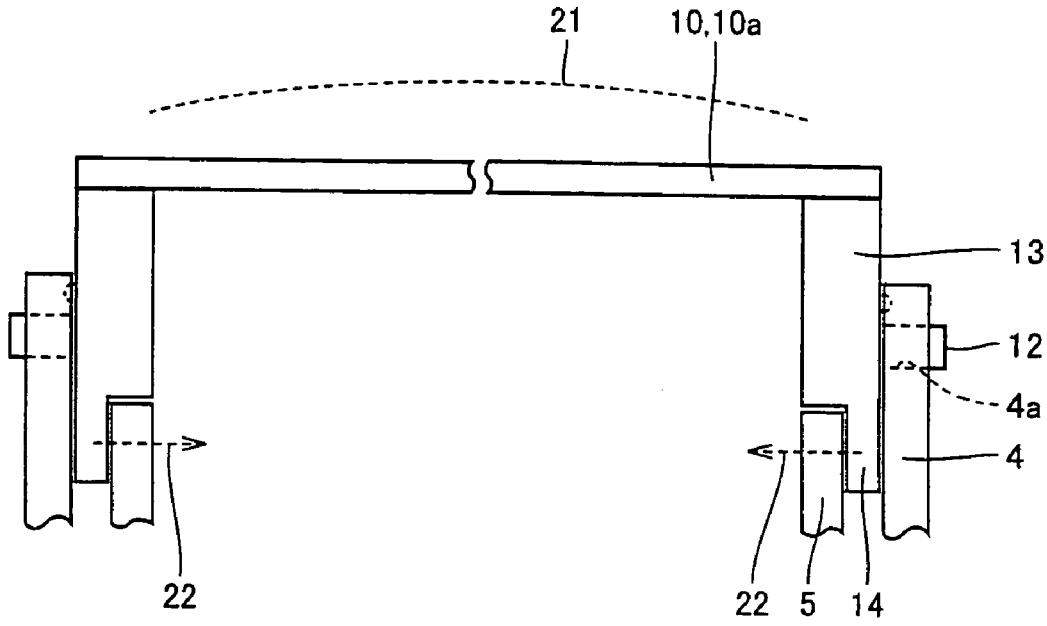
FIG. 7 is a front view showing a relation between the paper support and the bearing portions in the state shown in FIG. 6.

In contrast, as shown in FIGS. 6 and 7, when paper support 10 is tilted toward the printer body and closed, tab portion 14 provided at each of rotating shaft portions 11 engages engaging portion 5 provided at each of bearing portions 3. In this state, axial movement (an arrow 22) of paired rotating shaft portions 11 is restricted. Therefore, even if paper support 10 deforms in a direction away from the printer body, as shown in a dotted line 21, shaft body 12 is prevented from detaching from opening 4*a*, and rotating shaft portions 11 of paper support 10 are prevented from detaching from bearing portions 3 accordingly.

In addition, even if paper support 10 deforms to approach the printer body side opposite to the side shown in dotted line 21, movement of rotating shaft portions 11 is restricted by each of bearing portions 3 in this case. Therefore, rotating shaft portions 11 of paper support 10 are prevented from detaching from bearing portions 3.

According to the printer apparatus as described above, even if paper support 10 deflects in a direction away from or toward the printer body while paper support 10 is closed, tab portion 14 provided at each of rotating shaft portions 11 of paper support 10 engages engaging portion 5 provided at each of bearing portions 3, resulting in that axial movement of paper support 10 is restricted.

As a result, even if a certain impact is exerted on paper support 10 to deflect the same during transportation of printer apparatus 1, rotating shaft portions 11 of paper support 10 can be prevented from detaching from bearing portions 3. Furthermore, an additional procedure such as fixing of paper support 10 to printer body 2 with a tape as in the conventional printer apparatus is no longer required.

Furthermore, while paper support 10 is opened, paper support 10 can be detached from and attached to printer body 2. Therefore, although tab portion 14 is provided at each of rotating shaft portions 11, paper support 10 can be attached to printer body 2 without any troublesome procedure.

Figure 8:
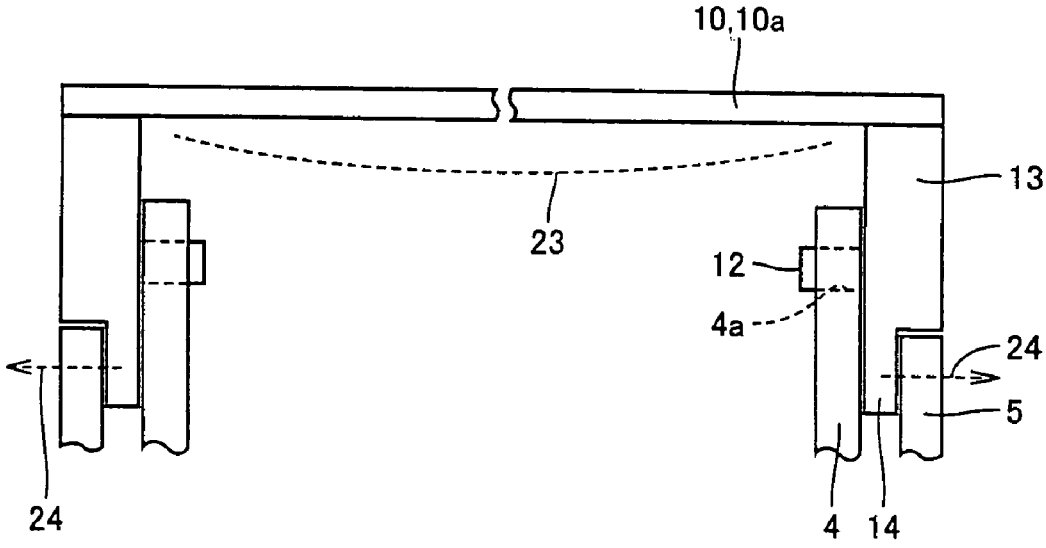
FIG. 8 is a front view showing a relation between the paper support and the bearing portions of a printer apparatus according to a modification of the present embodiment.
Figure 9:
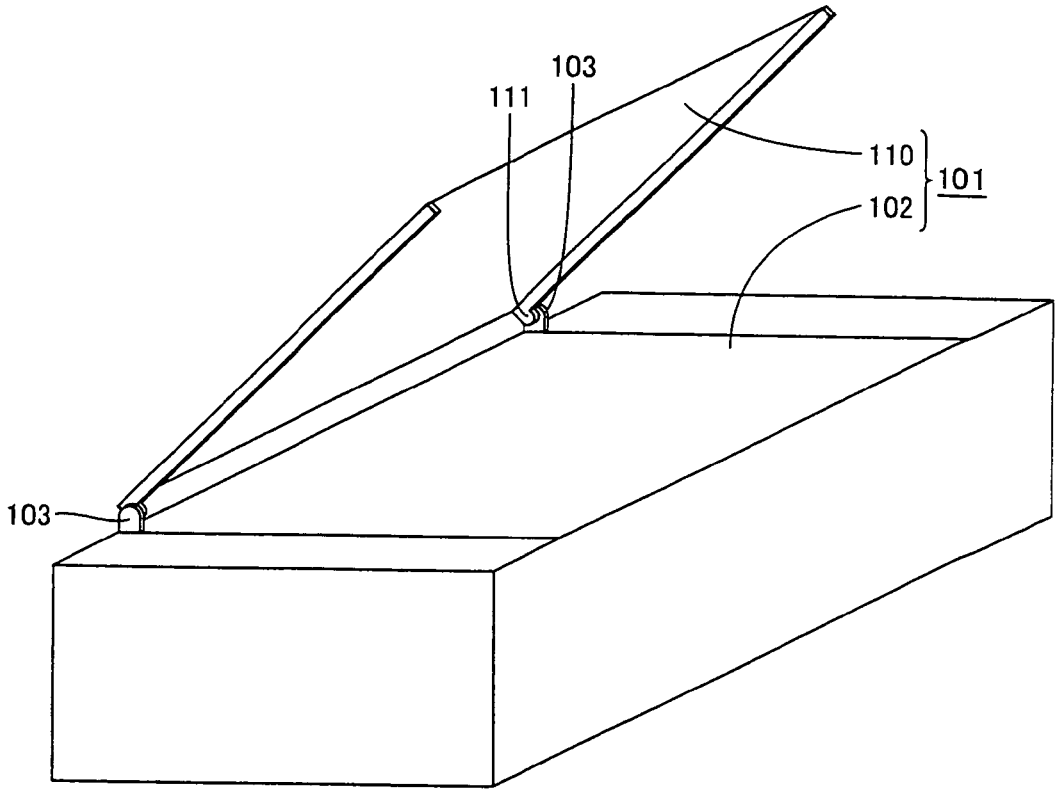
FIG. 9 PRIOR ART
FIG. 9 is a perspective view of a conventional printer apparatus.
Figure 10:
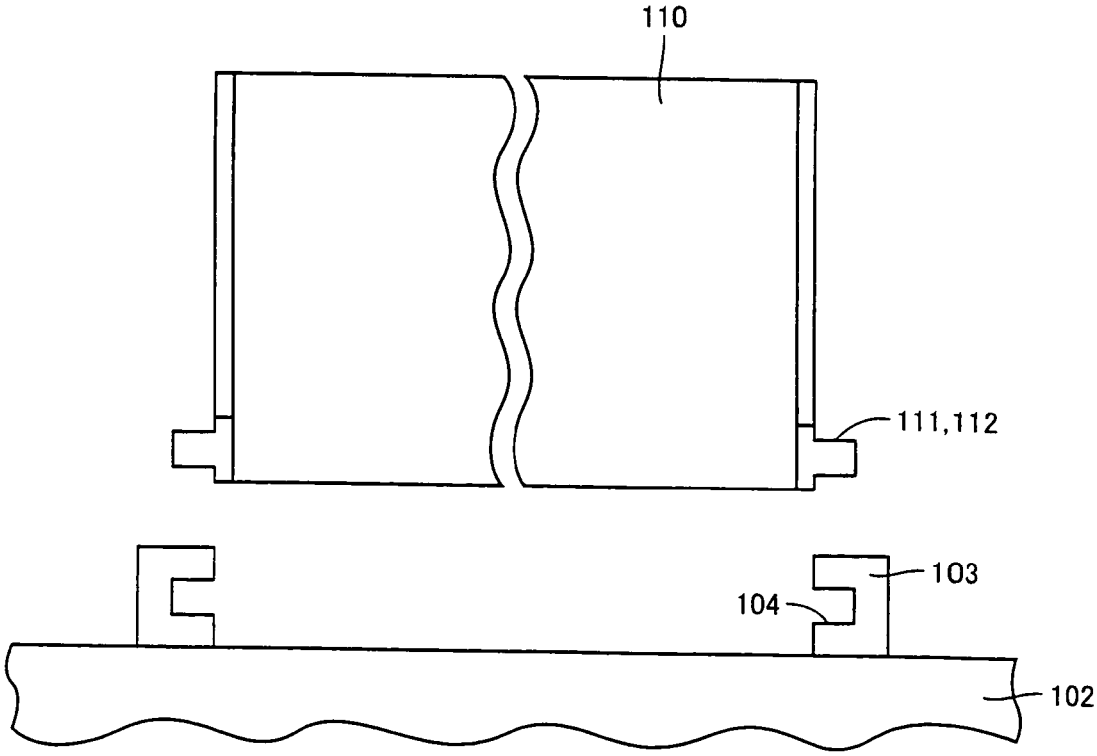
FIG. 10 PRIOR ART
FIG. 10 is an exploded front view showing a relation between the paper support and the bearing portions in the conventional printer apparatus.
Figure 11:
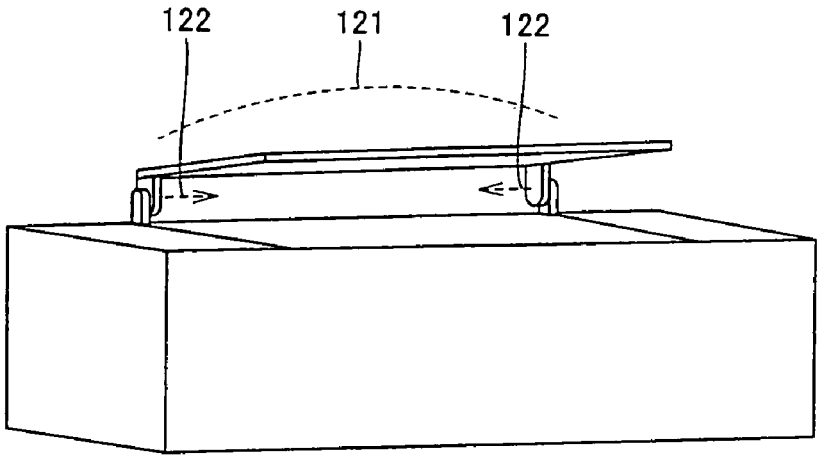
FIG. 11 PRIOR ART
FIG. 11 is a perspective view showing a problem in the conventional printer apparatus.
Figure 12:
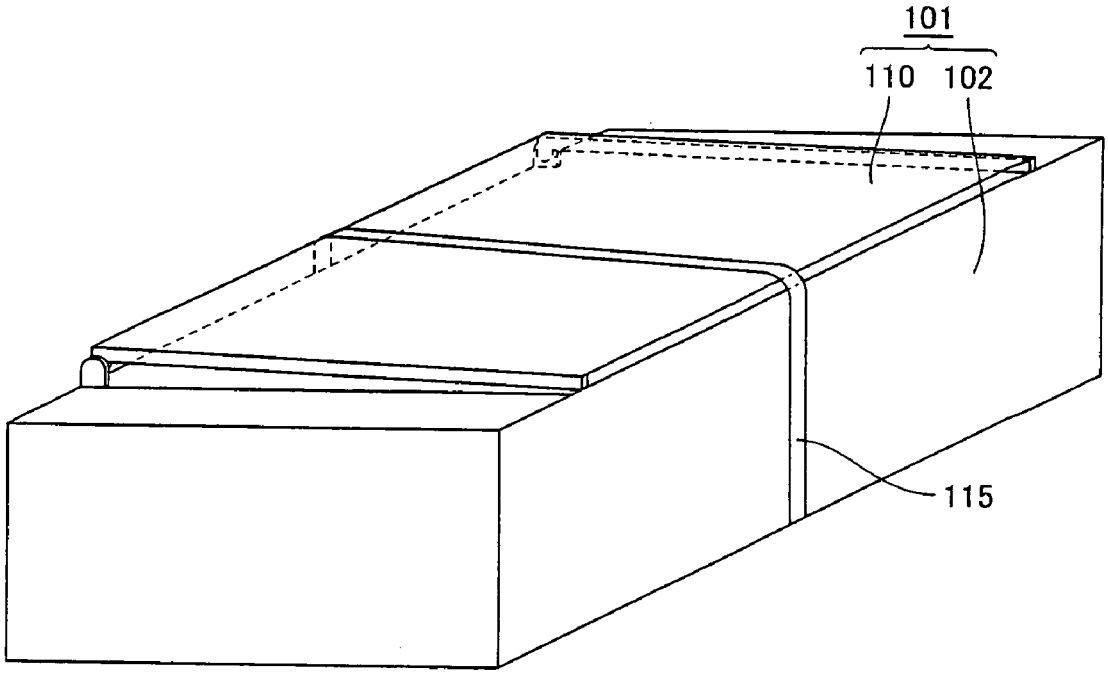
FIG. 12 PRIOR ART
FIG. 12 is a perspective view showing how the conventional printer apparatus is transported.

For the above-described printer apparatus 1, there has been described, by way of illustration, a case where paired rotating shaft portions 11 of paper support 10 are journaled at bearing portions 3 provided at printer body 2, on sides where bearing portions 3 face each other. In addition to this, a printer apparatus may be such that paired rotating shaft portions 11 are journaled at bearing portions 3 provided at printer body 2, on sides opposite to the sides where bearing portions 3 face each other. In this case, as shown in FIG. 8, shaft body 12 is formed at shaft support portion 13 at each of paired rotating shaft portions 11 to protrude from a side where paired rotating shaft portions 11 face each other, while engaging portion 5 is formed at bearing body 4 at each of paired bearing portions 3 on a side opposite to a side where paired bearing portions 3 face each other, for receiving tab portion 14 to restrict axial movement of rotating shaft portions 11.

In this type of printer apparatus, even if paper support 10 deflects in a direction away from or toward the printer body while paper support 10 is closed, tab portion 14 provided at each of rotating shaft portions 11 of paper support 10 engages engaging portion 5 provided at each of bearing portions 3, also resulting in that axial movement of paper support 10 is restricted.

As a result, even if a certain impact is exerted on paper support 10 to deflect the same during transportation of printer apparatus 1, rotating shaft portions 11 of paper support 10 can be prevented from detaching from bearing portions 3.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer apparatus, comprising:

a printer body for printing on a paper sheet;

a paper support attached to said printer body, and including a flat plate portion for supporting the paper sheet to be fed to said printer body;

paired bearing portions provided at said printer body to face each other; and paired rotating shaft portions provided at said paper support, and rotatably journaled by said paired bearing portions, wherein each of said paired rotating shaft portions includes a shaft body protruding from a side opposite to a side where said paired rotating shaft portions face each other, a shaft support portion provided at said flat plate portion to support said shaft body, a tab portion provided at said shaft support portion, and a protruding portion formed at said shaft support portion on the side opposite to the side where said paired rotating shaft portions face each other, each of said paired bearing portions includes a bearing body for receiving and journaling said shaft body, an engaging portion formed at said bearing body on a side where said paired bearing portions face each other, and receiving said tab portion to restrict axial movement of said rotating shaft portions, and a recess formed at said bearing body on the side where said paired bearing portions face each other, and receiving said protruding portion, when said protruding portion is received in said recess, and said paper support is opened to stand with respect to said printer body so that the paper sheet can be fed, said tab portion disengages from said engaging portion, resulting in that said paper support is made detachable from and attachable to said printer body, and when said paper support is tilted toward said printer body to be closed, said tab portion engages said engaging portion, resulting in that axial movement of said paper support is restricted.

2. A printer apparatus, comprising:

a printer body for printing on a paper sheet;

a paper support attached to said printer body for supporting the paper sheet to be fed to said printer body;

paired bearing portions provided at said printer body to face each other; and paired rotating shaft portions provided at said paper support, and rotatably journaled by said paired bearing portions, wherein each of said paired rotating shaft portions includes a tab portion, each of said paired bearing portions includes an engaging portion for receiving said tab portion to restrict axial movement of said rotating shaft portions, when said paper support is opened to stand with respect to said printer body so that the paper sheet can be fed, said tab portion disengages from said engaging portion, resulting in that said paper support is made detachable from and attachable to said printer body, and when said paper support is tilted toward said printer body to be closed, said tab portion engages said engaging portion, resulting in that axial movement of said paper support is restricted.

3. The printer apparatus according to claim 2, wherein said paired rotating shaft portions are journaled at said paired bearing portions on either of sides where said paired bearing portions face each other, and sides opposite to the sides where said paired bearing portions face each other.

4. The printer apparatus according to claim 2, wherein each of said paired rotating shaft portions includes a shaft body, each of said paired bearing portions includes a bearing body for receiving and journaling the shaft body, and said shaft body is formed to protrude toward said bearing body.

5. The printer apparatus according to claim 2, wherein each of said paired rotating shaft portions includes a protruding portion protruding toward corresponding one of said bearing portions of said paired bearing portions, each of said paired bearing portions includes a recess for receiving said protruding portion, and when said protruding portion is received in said recess, said paper support is opened to stand with respect to said printer body so that the paper sheet can be fed.

* * * * *